United States Patent [19]

Buob et al.

[11] 4,292,271

[45] Sep. 29, 1981

[54] METHODS OF APPLYING BONDING MATERIALS ONTO FIBROUS WEBS

[75] Inventors: James F. Buob; Walter L. Pauls, both of Appleton, Wis.

[73] Assignee: American Can Company, Greenwich, Conn.

[21] Appl. No.: 108,022

[22] Filed: Dec. 28, 1979

[51] Int. Cl.[3] ..... B29J 5/00

[52] U.S. Cl. ..... 264/518; 264/113; 264/128

[58] Field of Search ..... 264/518, 113, 128

[56] References Cited

U.S. PATENT DOCUMENTS

| | | | |
|---|---|---|---|
| 3,515,609 | 6/1970 | Rudloff | 264/113 |
| 4,155,968 | 5/1979 | Yamamoto | 264/113 |
| 4,165,352 | 8/1979 | Volkman | 264/113 |

*Primary Examiner*—Donald E. Czaja
*Assistant Examiner*—James R. Hall
*Attorney, Agent, or Firm*—Robert P. Auber; George P. Ziehmer; Paul R. Audet

[57] ABSTRACT

Methods by which a dry-formed loose fibrous web is bonded by applying to one of its surfaces a low add-on level of a relatively high binder solids concentration bonding material to form a once-bonded web, and to the other side of the web, a greater add-on level of a relatively lower solids concentration bonding material, the first-applied emulsion preferably adding from about 20% to about 40% binder solids by weight, and the second-applied adding the rest of the total binder solids to be included in the fibrous web product. The bonding material can be a solution or emulsion. Preferably, the first and second-applied bonding materials are water-based latex emulsions, the solids concentration of the first-applied emulsion is from about 15% to about 25% by weight, that of the second-applied emulsion is from about 10% to about 20% by weight based on the total binder solids to be included in the fibrous web product, and a vacuum draws the second-applied bonding material into the web.

33 Claims, 1 Drawing Figure

METHODS OF APPLYING BONDING MATERIALS ONTO FIBROUS WEBS

BACKGROUND OF THE INVENTION

This invention relates to methods of dry-forming fibrous products. More particularly, the invention is directed to methods for bonding loose fibrous webs and for bonding fibrous webs which have some integrity.

It has heretofore been a practice in dry-forming systems to dry-form a loose continuum of fibers, hereafter referred to as a loose fibrous web or loose web on a moving foraminous forming surface, and because the loose fibrous web is very weak, to bond its fibers and give it integrity sufficient for its handling and processing into a desired fibrous web product. One method of bonding the fibers is to include a mix particulate adhesive material with the fibers, deposit them together onto the forming surface and then activate the adhesive with water and/or heat. Another method is to spray adhesive onto the fibers as they are airborne within a distributor or as they are in transit from a distributor to the forming surface. Still another technique is to dry-lay the fibers onto a moving foraminous carrier wire or screen and, at a first bonding station (hereafter termed Bond I), spray a binder solids-bearing emulsion onto one side of the dry-laid loose fibrous web; heat the adhesive solids-bearing loose web (at a station termed Dry I) to at least partly dry and perhaps partly cure the binder and form a once-bonded fibrous web having some integrity; transfer the once-bonded web to a second moving foraminous carrier wire while inverting the web, and, at a second bonding station (hereafter termed Bond II), spray the emulsion onto the other side of the web. The twice-bonded web is again heated to partly or fully dry the binder and then the binder is cured to provide a fully bonded fibrous web product. This latter technique is described in a portion of commonly assigned pending Patent Application Ser. No. 081,791. In accordance with the latter technique, the emulsion, usually a water-based latex material, is applied in the same amounts and at the same adhesive solids concentrations to each side of the web. For example, if it were desired to manufacture a fibrous web product suitable for use as a wiper and having a basis weight of 45 lbs. per 3000 sq. ft. ream, of which 10 lbs. were binder solids, roughly the same amount of same the emulsion of a certain solids concentration would be sprayed onto each side of the web to add 5 lbs. of solids to one side and 5 lbs. of solids to the other side of the web.

While the aforementioned technique is commercially satisfactory, it is an object of this invention to improve certain aspects of the technique. With respect to dry-forming systems which employ two foraminous carriers, one to carry the loose web through Bond I, and one to carry the adhesive-bearing loose web through Dry I, this invention seeks to reduce the water content of the emulsion sprayed onto the loose web at Bond I because as the water content of the loose web increases, problems in transferring the web from one carrier to the other also increase. The wetter the web, the more it tends to stay on a carrier. In such interrupted carrier systems and those systems wherein a common carrier is employed between Bond I and Dry I, the water content of the web increases the load imposed on the dryer at Dry I. With a common carrier, the binder solids added on by the emulsion at Bond I require a certain volume of water to wash the carrier free of solids before a portion of the carrier can be reused to carry more freshly deposited loose fibers. Some of this wash water is carried with the carrier into the dryer and increases its load. Thus, for common or double carrier systems, this invention aims to reduce the add-on level of the emulsion sprayed on at Bond I and the volume of wash water needed at the Bond I, Dry I stations. This would reduce the load imposed on the dryer at Dry I.

This invention also endeavors to reduce the total binder solids used to bond air laid webs, and to reduce solids content of the emulsion used at Bond I to the extent that still permits the formation of once-bonded webs which are commercially transferable from station to station. Having discovered that the efficiency of latex solids as a binder for air laid webs increases if and to the extent that a vacuum is drawn from under the carrier, preferred embodiments of this invention uniquely utilize a vacuum, as high a vacuum as possible, near Bond II to increase solids penetration into the web and thereby increase latex solids efficiency.

As compared to the previously-practiced double spray application bonding technique, the methods of this invention also involve applying the binder solids bearing emulsion at the same or different binder solids concentrations and at different solids add-on levels at each Bond station. In accordance with preferred methods of this invention, at Bond I, a minor add-on of emulsion having a relatively high 20% to 30% binder solids concentration based on the weight of the emulsion, applies only about 20 to about 40% of the total adhesive solids to be applied to the web.

At Bond II, a major add-on of emulsion having about a 15% by weight binder solids concentration applies the rest, i.e. about 60% to about 80% of the total binder solids to be applied to the web. Thus, for example, to manufacture a 45 lbs. basis weight wiper whose weight includes a total of about 10 lbs. of binder solids, at Bond I, a low add-on of emulsion having about a 20% solids concentration would apply about 3.3 lbs. of binder solids, and at Bond II, a greater add-on of emulsion having about 15% solids concentration would apply about 6.6 lbs. of binder solids to the web.

The previously referred to endeavors of improvement are met because providing a low emulsion add-on level at Bond I, minimizes the web water content there and consequently alleviates web transfer problems in double carrier systems and minimizes dryer loads for both common and double carrier systems. Reducing the binder solids concentration from the conventional level of 50% to from about 20% to about 40% reduces the wash water requirements which also reduces dryer loads. Providing a higher solids add-on level at Bond II where a high vacuum can be drawn, maximizes binder solids efficiency and thereby permits the production of webs and products having less total binder solids than previously. This reduces binder solids containing bonding material and curing energy costs. Even when the total binder solids add-on is the same for wiper products made according to the methods of this invention as for wiper products produced by the previous double adhesive application techniques, it has been found that tensile strengths of the former are greater than those of the latter; it has also been found that drawing a vacuum in cooperation with the second application obtains web products whose tensile strength values are greater than if no vacuum were so drawn. Further, wiper products made in accordance with the methods of the invention have an improved feel and a different appearance than those made by the previous 50%—50% add-on techniques. The wiper's Bond I low solids add-on side feels smoother and softer than the Bond II high solids add-on side, or than the Bond I side of the previous wiper. When a high vacuum is drawn at Bond II, the Bond II high solids add-on side tends more to take on the pattern of the foraminous carrier and have more of a cloth-like appearance than its Bond I side, or that side of the previous wiper.

It is an object of this invention to provide methods for bonding loose fibrous continuums or webs, especially dry-formed ones.

Another object of this invention is to provide methods of applying binder solids-bearing bonding materials onto loose fibrous continuums or webs, especially dry-formed ones.

Another object is to provide improved methods of applying binder solids bearing emulsions onto both sides of dry-formed fibrous webs.

Another object is to provide the aforementioned methods which reduce the total quantity of solids needed to bond such webs.

Another object is to provide the aforementioned methods which utilize a vacuum to increase bonding material penetration, efficiency and web product tensile strength.

Still another object of this invention is to provide the aforementioned methods which reduce the cost of producing such webs.

DETAILED DESCRIPTION OF THE DRAWING AND INVENTION

Figure 1:
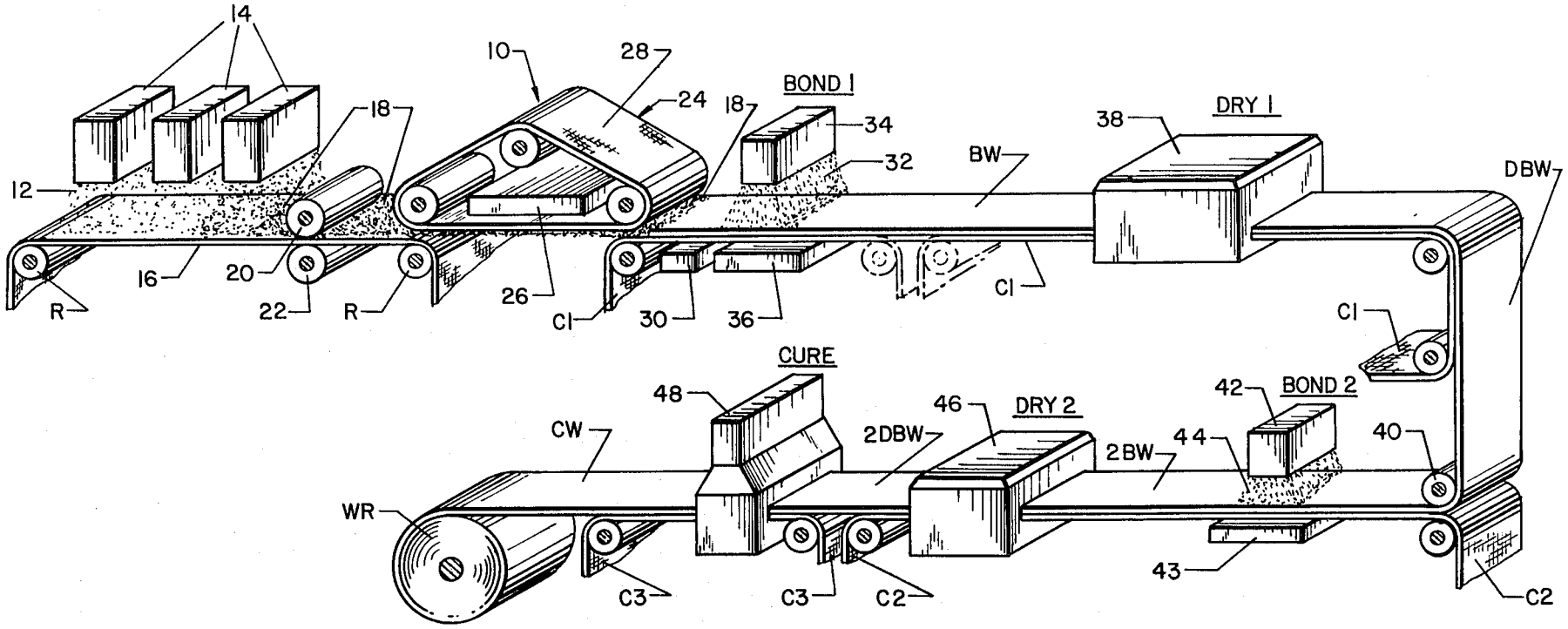
FIG. 1 is a schematic view with portions broken away, of apparatus for carrying out the methods of this invention.

Referring to the drawing in detail, FIG. 1 shows a preferred embodiment of an apparatus for carrying out a preferred method for producing dry-formed, nonwoven, bonded fibrous webs. More particularly, FIG. 1 shows an air-laying apparatus generally designated 10, comprised of various elements and by which fibers 12 of the air-laying type are formed into a bonded fibrous web product. Fibers 12 are air deposited by conventional means such as distributors 14 onto an underlying, endless, foraminous carrier, here, forming wire 16, broken away for simplicity and moving from left to right on suitable rollers R, two of which are shown. On forming wire 16, fibers 12 accumulate as loose fibrous web 18 which is lightly compacted by compaction rollers 20, 22 and transferred from forming wire 16 to foraminous roller-supported endless carrier C1 by means of a vacuum transfer unit, generally designated 24. More particularly, a vacuum imparted from vacuum box 26 lifts the continuum from wire 16 onto the undersurface of foraminous roller-supported endless belt 28, and a slight vacuum imparted from vacuum box 30 at the beginning of the first bonding station (shown in the drawing as "BOND I"), draws the continuum from belt 28 onto carrier C1. Carrier C1 carries the continuum through BOND I where it is provided with a suitable bonding material, here, a water-based binder solids-containing emulsion 32, which is applied by a suitable bonding material applicator means, here, a spraying means, generally designated 34, and is drawn onto the loose fibrous web by a slight vacuum applied from vacuum box 36 positioned below carrier C1, vertically under spraying means 34. The resulting once-bonded web BW, having had the emulsion sprayed onto its upper surface, is passed on carrier C1 to the first drying station (shown in the drawings as "DRY I") and through a first drying oven 38 which, at DRY I, subjects the web to a temperature effective for at least partially drying the bonding material employed. When a water-based latex binder solids-containing emulsion is employed as the bonding material, preferably, oven 38 is set at a temperature of from about 350° to about 380° F. and heats the web to a temperature in the range of from about 180° F. to about 200° F. The once-bonded, first dried web DBW exits oven 38 at about that temperature and usually contains less than about 5% by weight moisture, based on the total weight of the partially dried web. As carrier C1 passes around roll 40, the web is inverted and transferred onto another foraminous roller-supported endless carrier C2, which transports the web through the second bonding station (shown as "BOND II") where the web is passed under another bonding material applicator means, here, another spraying means 42, which applies bonding material, here, preferably the same type of emulsion 44, onto the inverted surface of web DBW. Preferably a box 43 positioned under carrier C2 and under spraying means 42 applies a vacuum, preferably a high vacuum, which draws the bonding material onto the web. The resulting twice bonded web 2BW is then transported through a second drying oven 46 at the second drying station ("DRY II"). Oven 46 is usually set at from about 370° F. in order to subject the web to a temperature effective for at least partially drying and preferably for substantially completely drying the particular bonding material employed. When a water-based latex emulsion is employed as the bonding material, preferably oven 46 heats the web to a temperature within the range of from about 270° F. to 280° F. At such temperatures twice-bonded dried web 2BW usually has a moisture content of less than about 1% based on the total weight of web 2BW. The actual heating temperatures employed by the drying and curing ovens are selected according to known practices and generally will depend not only on the bonding material used, but also on the process line speed, and the degree and completeness of drying desired by the respective drying ovens and by curing oven 48.

From DRY II, twice bonded and dried web 2DBW is moved from carrier C2 through an open pass onto another roller-supported, foraminous endless carrier C3 which moves the web through curing over 48, which in turn heats the bonding material to a temperature sufficient to cure it and substantially completely dry the web. When the bonding material is a water-based latex emulsion, an effective curing oven temperature is about 400° F. At this oven temperature, the web is heated to from about 290° F. to 310° F., and the resulting cured fibrous web product CW exits oven 48 is wound up on a suitable parent windup roll WR. At times it may be desirable to utilize the Dry II oven for both drying and curing.

In carrying out the preferred methods of this invention, the basic idea is to provide two applications of binder solids-containing bonding materials onto a fibrous web such that each application applies such a bonding material having the same or a a different binder solids concentration and a different solids add-on level. The idea is to utilize in the first application a high solids-concentration bonding material to effect a low solids add-on, and, in the second application, to utilize a relatively lower solids concentration emulsion to effect a relatively high solids add-on. The point in the first application at Bond I where very little if any vacuum can be applied, is to utilize as little as possible of as highly concentrated a bonding material as practically possible to minimize Bond I dryer loads and to add-on to the loose fibrous web the least binder solids which will provide it with the integrity required by the apparatus configuration for appropriately handling the loose web at the Bond I station and transferring it from there to Dry I stations. The point in the second application at Bond II is to apply most of the binder solids there to take advantage of the higher vacuum pressures employable there and thereby maximize solids penetration into the once-bonded web and maximize solids efficiency of use.

Of course, an objective always to be sought in considerations of applications of solids concentrations both at Bond I and Bond II is to utilize the least total solids possible which will provide the desired tensile strength and other desired web characteristics. Not only is it desirable to use as low total solids as possible, for economic reasons, but also the less solids present in the web, the better its liquid absorption capabilities will be.

Bonding materials which can be employed in the methods of this invention are selected from the group consisting of binder solids-containing solutions and emulsions and include any such bonding materials suitable for bonding fibers. As used herein "fibers" includes natural fibers, most desirably paper making fibers, especially those whose average length is generally about ¼ inch or less, and/or synthetic fibers and filaments and combinations thereof. Although bonding materials such as polyvinyl acetates, polyvinyl alcohols, starches, and dextrin solutions, and emulsions or dispersions can be employed, for webs comprised entirely or mostly of papermaking fibers, it is expected that the most satisfactory results will be obtained with suitable emulsions, especially water-based latex emulsions. Examples of such materials are acrylic, acrylic vinyl, styrene butadiene, and, most preferably, vinyl acetate-ethylene polymer-containing emulsions, some of the latter of which are commercially available for example, from Air Products and Chemicals, Inc. under its trademarks, Flexac, e.g. Flexac 180; Flexbond, e.g. Flexbond 330; Airflex, e.g. Airflex 100HS, 456, 105 and 120; Vinac, e.g. Vinac 880 and 881; and Vinar, e.g. Vinar 201 and 241. The preferred bonding material is Airflex 120 diluted with water. Preferably, to the diluted latex emulsion a sufficient amount of a suitable surfactant and a catalytic agent are added. For use with Airflex 120, a preferred surfactant is the anionic re-wetting agent sold as Deceresol OT, a registered trademark of and commercially available from American Cyanamid Company. An example of a suitable catalytic agent which may be added to the emulsion to promote cross-linking of the polymer material is sodium bisulphate.

Although the emulsion applied at Bond I and Bond II need not be the same, for bonding papermaking fibers and forming fibrous web products such as wipers, preferably both emulsions are water-based latex emulsions, and in most instances desirably they are of the same latex polymer type.

As obtained, water-based latex emulsions commonly contain from about 45% to about 60% by weight latex solids. As obtained, Airflex 120 might contain from about 45% to about 52% by weight latex solids, but usually, as received, it contains about 52% by weight latex solids.

The binder solids concentration of the first-applied binding material may be the same as that of the second-applied bonding material when a vacuum is employed to assist penetration of the second-applied bonding material, but preferably it is greater than that of the second-applied bonding material. It has been found that loose fibrous webs comprised of softwood Kraft papermaking fibers deposited on brass foraminous forming wires for ultimately forming from about 38 lbs. to about 50 lbs. basis weight web products (per 3000 sq. ft. ream) can be satisfactorily bonded at Bond I and handled and transferred between Bond I and Dry I and from the Dry I to Bond II with the latex solids-containing emulsion Airflex 120, having a latex binder solids concentration from above 15% to about 25% by weight preferably above about 17%, and most preferably about 20% by weight, based on the total weight of the emulsion applied to the loose web. It has been found that apparatus configurations which employ a double carrier wire and roller support system such as indicated by the dotted lines in FIG. 1, require the transfer of once-bonded webs from the Bond I carrier to the Dry I carrier, and do not impart a vacuum from vacuum box 36, a first-applied emulsion of Airflex 120 diluted to a solids concentration of 17% by weight may so wet the loose web as to at times tend to cause problems in separating it from the Bond I carrier and in transferring it to the Dry I carrier. In the just described double carrier system, solids concentrations at or below 15% by weight so wet the loose web as to unduly adhere to the Bond I carrier and render the once-bonded web commercially too difficult to separate and transfer it to the Dry I carrier wire. It has also been found that as the binder-solids concentration increases, it becomes increasingly difficult to spray the emulsion and to obtain proper latex solids penetration into the loose web. With respect to Airflex 120, at concentrations above 25% by weight, some latex solids increasingly accumulate on the loose web surface as wasteful, penetration-preventing clumps or aggregates which do not contribute to web product strength. It can be generally stated then that the solids concentration of the first-applied emulsion should be great enough to provide the integrity the particular apparatus configuration requires to permit continuous transfers at commercial speeds from carrier to carrier between either Bond I and Dry I, or between Dry I and Bond II, yet not so great as to cause wasteful surface accumulations of solids and consequent reductions as to solids penetration and efficiency.

Although it is usually preferable to operate without a vacuum pressure at Bond I because the vacuum tends to increase adherence of the once-bonded continuum to carrier C1 and increase separation and transfer problems, it has been found that a slight vacuum pressure of 0.5 inch water or less at 200 feet per minute air velocity may in certain applications be tolerable within the aforementioned solids concentration range of from about 15% to about 25% by weight, to control overspray and hold the loose web on and prevent it from being lifted from carrier C1 by the spray velocity imparted from spraying means 34.

In preferred embodiments of the methods of this invention, the binder solids concentration of the second-applied bonding material is generally within the range of from about 10% to about 20%, although for water based latex emulsions, desirably it is about 17%, preferably about 15%, by weight, based on the total weight of the emulsion applied to the web DBW. Although one advantage provided by the methods of this invention is the ability to use a lower amount of total binder solids in the web product, with respect to the apparatus shown in FIG. 1 and the bonding of the inverted side of dried once-bonded web DBW, reducing the solids concentration of the second-applied emulsion below 15% by weight has not been found to increase the efficiency of the latex binder solids with respect to the web product's tensile strength, nor does it increase a web's tensile strength over that obtained with a 15% concentration. In fact, dilution to below 15% starts to significantly increase the load of dryer 46, and dilution to below 10% binder solids by weight totally wets the twice-bonded web and consequently unduly loads dryer 46. However, for web products whose basis weight is heavier than the 38 to 50 lbs. range suitable for making moderate-to-heavy wipers, for example, for web products whose basis weight is about 100 lbs. (per 3000 sq. ft. ream), emulsions diluted to less than 10% by weight binder solids might well provide the desired binder solids efficiencies. Likewise, with respect to lighter basis weight webs such as tissue products whose basis weight is near 20 lbs. (per 3000 sq. ft. ream), the optimum solids concentration might well be near 20% by weight.

Although a vacuum need not be imparted from under the foraminous carrier at Bond II, it is highly desirable to impart a vacuum there, preferably as high a vacuum as possible to obtain maximum binder solids penetration and efficiency since in preferred embodiments most of the solids to be included in the web product are applied at Bond II. Although satisfactory results have been obtained with a double carrier system as shown in FIG. 1, when the vacuum pressure applied under the carrier at Bond II is between about 2 to 5 inches of mercury at about 400 to 450 cubic feet per minute of air applied by a particular vacuum pump of somewhat limited capabilities, through a ¼" slot and measured under the carrier, the vacuum pressure to be applied may be significantly greater and should be selected in accordance with known factors such as the power of the vacuum pump or system employed, the slot width through which it is imparted, the thickness of the web through which the vacuum is to be drawn, and the placement of the vacuum system relative to the bonding material applicator means. If the bonding material is sprayed onto the web, it is recommended that the vacuum box be directly under the spraying means.

The total amount of binder solids to be included in the web product is to be as low as possible. Practically, within limits, commercially acceptable web tensile strengths determined for certain high wet strength products to be CD wet tensiles of 750 grams per 3"×9" inch strips, can be obtained as well with low as with high solids levels. As previously explained, high solids additions tend to accumulate on the web surface and prevent good solids penetration which is a key to obtaining both acceptable tensile strengths and solids efficiencies. Also, the less total solids present in the web product, the better are its liquid absorption capabilities.

Of the total binder solids desired to be included in the web product, the first-applied and the second-applied bonding materials may add the same percentage thereof when a vacuum is used to assist penetration of the second-applied bonding material, but preferably the first-applied bonding material adds to the web a relatively minor or low percentage, and the second-applied adds the rest, or a relatively major or higher percentage thereof. Minor here means from measurable effective fiber bonding amounts to 45 percent by weight, and major means from 55% up to less than 100% by weight, based on the total weight of binder solids to be included in the fibrous web product. Relatively low here means less than about 40% by weight of the total solids to be included in the web product.

For latex-bonded fibrous web products suitable for use as moderate-to-heavy wipers, particularly those having one side which tends to be smoother than the other side, the first-applied emulsion adds on from about 20% to about 40% by weight, preferably about 30% about 35% by weight, of the total binders solids to be added on to or included in the fibrous web product. The second-applied emulsion adds on the rest, i.e., from about 60% to about 80%, preferably about 65% to about 70% by weight of the total binder solids to be added onto or included in the fibrous web product. Although it has been found that below about 20% by weight solids, the once-bonded web tends to be too weak to transfer from a Bond I carrier to a Dry I carrier, desirably the solids add-on is as low as practicable at Bond I where little or no vacuum is applied, and solids add-on is as great as possible at Bond II, where a high vacuum can be applied to increase solids penetration. Of course, the solids level to be added on by the respective first and second-applied emulsion and the total solids to be employed will vary depending for example on the apparatus and carrier configuration, its gentleness or severity with respect to web handling and treatment, the bonding effectiveness of the particular binder solids employed, and the basis weight, tensile strength, liquid absorption, feel and performance characteristics desired of the web product.

The methods of this invention can be better understood from the Table below which shows examples of a conventional binder application method in Run A of Section I and in Runs A and B of Section II, and examples of the methods of this invention in the other runs.

TABLE

| RUN | VACUUM, BOND II (Inches Hg.) | ADD-ON LEVEL (Ratio % Of Total Binder Solids) BOND I | BOND II | TOTAL BINDER SOLIDS ADD-ON (#/Ream) | BINDER SOLIDS CONCENTRATION (%) BOND I | BOND II | BASIS WEIGHT (#/Ream) | BULK (Caliper ÷ Basis Weight) | CD WET TENSILE (Gms 3" / 9" Strip) |
|---|---|---|---|---|---|---|---|---|---|
| Section I | | | | | | | | | |
| A | 0 | 50 | 50 | 8.6 | 19.8 | 19.8 | 42.3 | 0.90 | 789 |
| AV | 4-5 | 50 | 50 | 8.6 | 19.8 | 19.8 | 42.0 | 0.86 | 883 |
| 1 | 0 | 20 | 80 | 8.6 | 14.6 | 14.6 | 43.1 | 0.85 | 988 |
| 1V | 4-5 | 20 | 80 | 8.6 | 14.6 | 14.6 | 42.7 | 0.81 | 1056 |
| 2 | 0 | 40 | 60 | 8.6 | 19.8 | 19.8 | 43.4 | 0.88 | 764 |
| 2V | 4-5 | 40 | 60 | 8.6 | 19.8 | 19.8 | 43.8 | 0.86 | 831 |
| 3 | 0 | 30 | 70 | 8.8 | 14.6 | 14.6 | 42.6 | 0.89 | 958 |
| 3V | 4-5 | 30 | 70 | 8.8 | 14.6 | 14.6 | 42.8 | 0.83 | 1039 |
| Section II | | | | | | | | | |

TABLE-continued

| RUN | VACUUM, BOND II (Inches Hg.) | ADD-ON LEVEL (Ratio % Of Total Binder Solids) BOND I | BOND II | TOTAL BINDER SOLIDS ADD-ON (#/Ream) | BINDER SOLIDS CONCEN-TRATION (%) BOND I | BOND II | BASIS WEIGHT (#/Ream) | BULK (Caliper ÷ Basis Weight) | CD WET TENSILE (Gms 3" × 9" Strip) |
|---|---|---|---|---|---|---|---|---|---|
| A | 0 | 50 | 50 | 10.2 | 20.1 | 20.1 | 44 | 0.82 | 1348 |
| AV | 4-5 | 50 | 50 | 10.2 | 20.1 | 20.1 | 44 | 0.77 | 1491 |
| 1 | | | | | (NOT RUN) | | | | |
| 1V | 4-5 | 30 | 70 | 10.2 | 20.1 | 14.9 | 46 | 0.77 | 1496 |
| B | 0 | 50 | 50 | 9.2 | 20.1 | 20.1 | 43.5 | 0.84 | 1158 |
| BV | 4-5 | 50 | 50 | 9.2 | 20.1 | 20.1 | 43.5 | 0.84 | 1251 |
| 2 | 0 | 30 | 70 | 9.2 | 20.1 | 14.9 | 48.9 | 0.74 | 1150 |
| 2V | 4-5 | 30 | 70 | 9.2 | 20.1 | 14.9 | 43.4 | 0.84 | 1408 |
| 3 | 0 | 30 | 70 | 8.2 | 20.1 | 14.9 | 44.7 | 0.87 | 847 |
| 3V | 4-5 | 30 | 70 | 8.2 | 20.1 | 14.9 | 45.4 | 0.80 | 1025 |
| 4 | 0 | 30 | 70 | 7.2 | 20.1 | 14.9 | 43.7 | 0.88 | 634 |
| 4V | 4-5 | 30 | 70 | 7.2 | 20.1 | 14.9 | 44.2 | 0.84 | 754 |
| Section III | | | | | | | | | |
| 1 | 0 | 30 | 70 | 8.46 | 20.3 | 14.8 | 43.8 | 0.82 | 1104 |
| 1V | 4-5 | 30 | 70 | 8.46 | 20.3 | 14.8 | 43.4 | 0.80 | 1243 |
| 2 | 0 | 30 | 70 | 7.97 | 20.3 | 14.8 | 43.3 | 0.87 | 997 |
| 2V | 4-5 | 30 | 70 | 7.97 | 20.3 | 14.8 | 42.4 | 0.83 | 1096 |
| 3 | 0 | 30 | 70 | 7.47 | 20.3 | 14.8 | 41.8 | 0.88 | 917 |
| 3V | 4-5 | 30 | 70 | 7.47 | 20.3 | 14.8 | 41.6 | 0.86 | 970 |
| 4 | 0 | 30 | 70 | 6.96 | 20.3 | 14.8 | 41.9 | 0.91 | 797 |
| 4V | 4-5 | 30 | 70 | 6.96 | 20.3 | 14.8 | 41.9 | 0.85 | 903 |
| 5 | 0 | 30 | 70 | 6.47 | 20.3 | 14.8 | 41.3 | 0.90 | 665 |
| 5V | 4-5 | 30 | 70 | 6.47 | 20.3 | 14.8 | 41.0 | 0.87 | 668 |

For all runs of all Sections: the moisture content of the loose webs entering Bond I was from about 5% to about 8% based upon the total weight of the loose web, and of the once-dried, once-bonded webs entering Bond II was from about 1% to about 2% by weight, based upon the total weight of the once-dried, once-bonded webs; the temperature setting of the Dry I and Dry II ovens for the runs of Section I were each 370° F. for runs A, AV, B, BV, 2 and 2V, and 370° F. and 400° F. respectively for runs 1, 1V and 3, 3V; for the runs of Section II both Dry I and Dry II ovens were set at 370° F. for all runs; and for Section III the Dry I oven was set at 350° F. for all runs, while the Dry II oven was set at 375° F. for runs 1, 1V, 2, 2V, 3 and at 370° F. for the other runs. No vacuum was drawn at Bond I, and the vacuum at Bond II was drawn through a ¼" wide slot; "#/Ream" means pounds per 3000 sq. ft. ream of paper; "Basis Weight" means the total weight of the fibers and binder (including any surfactant and catalytic agent) which comprise the dried fibrous web product produced by the particular run; Bulk was measured by dividing the caliper of a single sheet by the basis weight of that sheet; the binder was Airflex 120; the fibers were comprised of Kraft softwood papermaking fibers; "CD" means cross-machine direction; the apparatus utilized was similar to that of FIG. 1, except that a double carrier wire (dotted lines in FIG. 1) was used; line speed was from about 210 to about 250 feet/minute; and web width on the windup reel was 20 inches.

In accordance with the methods of this invention, the data shown in the Table indicates in Runs A and AV of Section I, and in Runs A, AV and B, BV of Section II, that imparting a vacuum at Bond II with equal solids concentration applications and equal add-on levels at Bond I and Bond II, increases the CD wet tensile strength of the web product; the data in the rest of Section I, indicates that greater increases in CD wet tensile strength can be obtained with or without a vacuum using equal solids concentration applications and differential binder solids add-on levels at Bond I and Bond II, relatively greater CD wet tensile strengths being obtainable with a vacuum at Bond II. The data in Sections II and III indicate that increases in CD wet tensile strength are obtainable with or without a vacuum using differential solids concentration applications and differential solids add-on levels, relatively CD wet greater tensile strengths being obtainable with a vacuum at Bond II. Sections II and III also show that in most instances, compared to the conventional Runs, the bulk of the final web product was increased when the methods of this invention were employed.

The Table also shows that, utilizing a vacuum at Bond II for the particular apparatus configuration, binder and method employed, also obtains increases in latex bonding material efficiency at total binder solids add-on levels as low as 6.96 pounds.

It is thought that the invention and many of its attendant advantages will be understood from the foregoing description, and it is apparent that various changes may be made in the steps of the methods and in the structures and materials described without departing from the spirit and scope of the invention or sacrificing all its material advantages, the methods, and the structures and materials hereinbefore described being merely preferred embodiments thereof.

We claim:

1. A method of forming a dry-formed bonded fibrous web product, which comprises:

dispensing fibers from a distributor onto a foraminous forming surface to form a loose web surface, applying a bonding material selected from the group consisting of binder solids-containing solutions and emulsions onto one side of the loose fibrous web to add to it from about 20% to about 40% by weight of the total binder solids to be included in the fibrous web product, heating the solids-bearing loose fibrous web to at least partly dry it and form a once-bonded web, applying a bonding material selected from the group consisting of binder solids-containing solutions and emulsions onto the other side of the once-bonded web to add to it the rest of the total binder solids to be included in the fibrous web product, and heating the web to thereby form a twice-bonded dry-formed cured fibrous web product, said first-applied bonding material having a greater binder solids concentration than said second-applied bonding material.

2. The method of claim 1 wherein the first applied bonding material has a binder solids concentration of from about 20% to about 25% by weight, and the second-applied bonding material has a binder solids concentration of about 15% by weight, said percents by weight being based on the total weight of the respective bonding materials.

3. The method of claim 2 wherein the first application applies from about 30% to about 35% by weight of the total weight of binder solids to be included in the web product.

4. The method of claim 1, 2 or 3 wherein there is included the steps of drawing a vacuum through the onced-bonded web while said second application is occurring, said vacuum being sufficient to draw the second-applied binding material into the once-bonded web.

5. The method of claim 4 wherein the vaccum drawn is within the range from about 2 to about 5 inches of mercury.

6. The method of claim 1, 2 or 3 wherein the first and second-applied bonding materials are emulsions.

7. The method of claim 4 wherein the first and second-applied bonding materials are emulsions.

8. The method of claim 6 wherein the emulsions are water-based latex bonding materials of the same latex polymer type.

9. The method of claim 7 wherein the emulsions are water-based latex bonding materials of the same latex polymer type.

10. A method of applying bonding material onto a dry-formed loose fibrous web, which comprises:

providing a dry-formed loose fibrous web on a first foraminous carrier surface, applying to one side of the loose fibrous web a binder solids-containing emulsion in an amount which adds to the loose fibrous web a minor percentage by weight of the total weight of solids to be included in the fibrous web, heating the continuum to at least partly dry the solids in the loose fibrous web to form a once-bonded web, transferring the once-bonded web to a second foraminous carrier surface to expose the unbonded side of the web, and applying to the unbonded side of the once-bonded web a binder solids-containing emulsion in an amount which adds a major percentage by weight of the total binder solids to be included in the web, said first-applied emulsion having a greater binder solids concentration than said second-applied emulsion.

11. The method of claim 10 wherein the first applied emulsion has a binder solids concentration of from about 20% to about 25% by weight, and the second applied emulsion has a binder solids concentration of about 15% by weight, said percents by weight being based on the total weight of the respective emulsions.

12. The method of claim 11 wherein the first application applies from about 20% to about 40% of, and the second application applies from about 60% to about 80% by weight of the total binder solids to be included in the web product.

13. The method of claim 12 wherein the first application applies from about 30% to about 35% by weight of the total solids to be included in the web product.

14. The method of claim 10, 11, 12 or 13 wherein there is included the steps of drawing a vacuum through the once-bonded web while said second application is occurring, said vacuum being sufficient to draw the second-applied bonding material into the once-bonded web.

15. The method of claim 10, 11, 12 or 13 wherein both emulsions are water-based latex bonding materials.

16. The method of claim 14 wherein both emulsions are water-based latex bonding materials.

17. The method of claim 15 wherein the binder solids of each emulsion are comprised of the same latex polymer type.

18. The method of claim 16 wherein the binder solids of each emulsion are comprised of the same latex polymer type.

19. The method of claim 10 wherein there is included the final additional step of heating the fibrous web and curing its binder solids to provide a cured twice-bonded, fibrous web product.

20. A method of forming a dry-formed bonded fibrous web product, which comprises:

dispensing fibrous from a distributor onto a foraminous forming surface to form a loose fibrous web, transferring said web from the forming surface to a first foraminous carrier surface, applying a water-based latex binder solids-containing emulsion bonding material onto one side of the loose fibrous web to add to it from about 20% to about 40% by weight of the total binder solids to be included in the fibrous web product, heating the solids-containing loose fibrous web to at least partly dry it and form a once-bonded web, transferring the once-bonded web to a second foraminous carrier surface to expose the other side of the web, applying additional water-based latex binder solids containing emulsion bonding material onto the other side of the once-bonded web to add to it the rest of the total binder solids to be included in the fibrous web product, and heating the web to thereby form a twice-bonded dry-formed cured fibrous web product, said first-applied emulsion having a binder solids concentration of about 20% by weight and said second-applied emulsion having a binder solids concentration of about 15% by weight, said percents by weight being based on the total weight of the respective emulsions.

21. The method of claim 20 wherein there is included the step of drawing a vacuum through the once-bonded web while said second applicatio is occurring.

22. The method of claim 21 wherein the vacuum drawn is within the range of from about 2 to about 5 inches of mercury.

23. A method of forming a dry-formed bonded fibrous web product, which comprises:

dispensing fibers from a distributor onto a foraminous forming surface to form a loose fibrous web, transferring said web from the forming surface to a foraminous carrier surface, applying a bonding material selected from the group consisting of binder solids-containing solutions and emulsions onto one side of the loose fibrous web, heating the solids-bearing loose fibrous web to at least partly dry it and form a once-bonded web, applying a bonding material selected from the group consisting of binder solids-containing solutions and emulsions onto the other side of the once-bonded web to thereby form a twice-bonded dry-formed fibrous web, drawing a vacuum through the once-bonded web to draw the second-applied bonding material into the once-bonded web, and heating the web to form thereby a twice-bonded dry-formed cured fibrous web product, the resulting twice-bonded fibrous web product having a greater tensile strength than if said vacuum had not been drawn.

24. The method of claim 23 wherein the first-applied bonding material adds to the loose fibrous web from about 20% to about 40% by weight of, and the second-applied bonding material adds to the once-bonded web the rest of the total binder solids to be included in the fibrous web product, and the first-applied bonding material is applied in a lesser quantity than the second-applied bonding material.

25. The method of claim 24 wherein the first and the second-applied bonding materials have the same binder solids concentration.

26. The method of claim 25 wherein the binder solids concentration of the respective bonding materials is from about 14% to about 20% by weight based on the total weight of the respective bonding materials.

27. The method of claim 26 wherein the first- and second-applied bonding materials are water-based latex bonding materials.

28. The method of claim 27 wherein the binder solids of each emulsion are comprised of the same latex polymer type.

29. The method of claim 24 further comprising the step of transferring the at least partly dried, once-bonded web to a second foraminous carrier surface to expose the unbonded side of the web, said unbonded side receiving thereby the second application of bonding material.

30. The method of claim 3, 19, 22 or 29 wherein the final heating step comprises at least a partial drying of the web followed by a separate curing of the web.

31. The method of claim 22 or 29 wherein the web is transferred from the forming surface to the first carrier surface by means of an intermediate foraminous surface, the web being invertedly held thereto by a vacuum drawn through said intermediate surface, and being removed therefrom by a vacuum drawn through said first carrier surface.

32. The method of claim 19, 22 or 29 wherein the web is transferred before the first heating step to another foraminous carrier surface, subsequent transfer of the web to said second carrier surface being made therefrom.

33. The method of claim 1, 10, 22 or 24 wherein there is included the step of drawing a vacuum of less than 0.5 inches of water through the web while said first application of bonding material is occurring.

* * * * *